United States Patent [19]

Kovacevic

[11] 4,057,058

[45] Nov. 8, 1977

[54] PROTECTION-HOOD OR HELMET-MASK FOR USE IN ENVIRONMENTS DANGEROUS TO WORK

[76] Inventor: Ostoja Kovacevic, Emil Korsmos vei 24, Oslo 6, Norway

[21] Appl. No.: 685,141

[22] Filed: May 11, 1976

[51] Int. Cl.[2] ..... A62B 7/00

[52] U.S. Cl. ..... 128/142.7; 128/142.6; 128/142.3

[58] Field of Search ..... 128/142.5, 142.6, 142.7, 128/145 R, 141 R, 142.3

[56] References Cited

U.S. PATENT DOCUMENTS

| | | | |
|---|---|---|---|
| 642,166 | 1/1900 | Sherman | 128/145 R |
| 1,561,086 | 11/1925 | Korjibski | 128/142.7 |
| 2,785,674 | 3/1957 | Wong | 128/142.7 |

*Primary Examiner*—Robert W. Michell
*Assistant Examiner*—Henry J. Recla
*Attorney, Agent, or Firm*—Young & Thompson

[57] ABSTRACT

A protection-hood or helmet-mask having double walls of transparent plastic material, which covers the whole head and by aid of an elastic collar is sealed to the wearer's neck. The space between the walls is divided by a partition wall into two identical halves to which hoses for supply and abduction of air are connected at the lower back of the hood. The air is led to the wearer through an opening in the inner wall at the wearer's mouth and nose. The air can be passed through the hood by overpressure or underpressure arrangements. An air filter is arranged upstream of the air inlet of the hood.

3 Claims, 3 Drawing Figures

B
5
6
4
7
1
2
3
14
13
A
A
B

PROTECTION-HOOD OR HELMET-MASK FOR USE IN ENVIRONMENTS DANGEROUS TO WORK

The invention concerns a protection-hood to be used in environments in which it is dangerous to work, including a hood-shaped construction which covers the whole head, and by the aid of an elastic collar stays close to the user's neck, as well as arrangements for supply and abduction of air through hoses which are connected to the hood. The hood fore use especially in places where there might be gases, dust etc., but it may also be used as a protection hood when diving.

In places of work where there are dust or dangerous gases, there are used dust-masks or gas-masks, and these are usually fitted with ventilators for breathing in and out which give a considerable resistance against the air-flow. These masks will, therefore, feel warm and clammy in use, since the resistance makes it difficult to breathe, and wet used air remains within the mask. It is therefore, difficult to get the workers to use such masks.

There are protection-hoods of a relatively elastic material, where through hoses or other similar arrangements is supplied air with a certain over-pressure, and this air together with respirated air leaks out through ventilators, filters or other places where air may escape around the neck of the user. (French Pat. No. 1.599.791).

If enough air is forced into these hoods to ensure that respirated air and evaporated perspiration with certainty are abducted, this will lead to a cold draught against the face of the user.

The aim of the invention is to provide a new and better protection-hood of the above mentioned type, in which the mentioned disadvantages are avoided.

This is according to the invention achieved by the characteristic feature that the hood around the head itself is formed in a stiff, clear plastic material with double walls, and by forming a partition wall between the double walls, and also by making an opening in the inner wall in front of the nose and mouth, by attaching an air supply hose to the space between the double walls on the one side of the partition wall, and by attaching a suction arrangement in the abduction hose, for example the suction side of a fan, or by attaching an air supplying arrangement in the supply hose. The air which passes into the hood is filtered in respect of gases and/or aerosals.

The advantages of this protection-hood are that it enables one to lead relatively large quantities of air through the hood without imposing dangerous draughts on the wearer, at the same time as clean breathing air with a high amount of oxygen is maintained within the mask, without impairing vision with condensed breathing vapour.

Since the protection-hood is made of a stiff, clear material, and since the collar is made in an elastic material, a good view from the mask is achieved. The double walls will help to reduce the noise from the outside sources, often found in working places with dust or dangerous gases, as for example in mines, workshops and chemical industries.

The invention will be further described by the following with reference to the drawings, and other characteristics of the invention will also be seen from this description.

Figure 1:
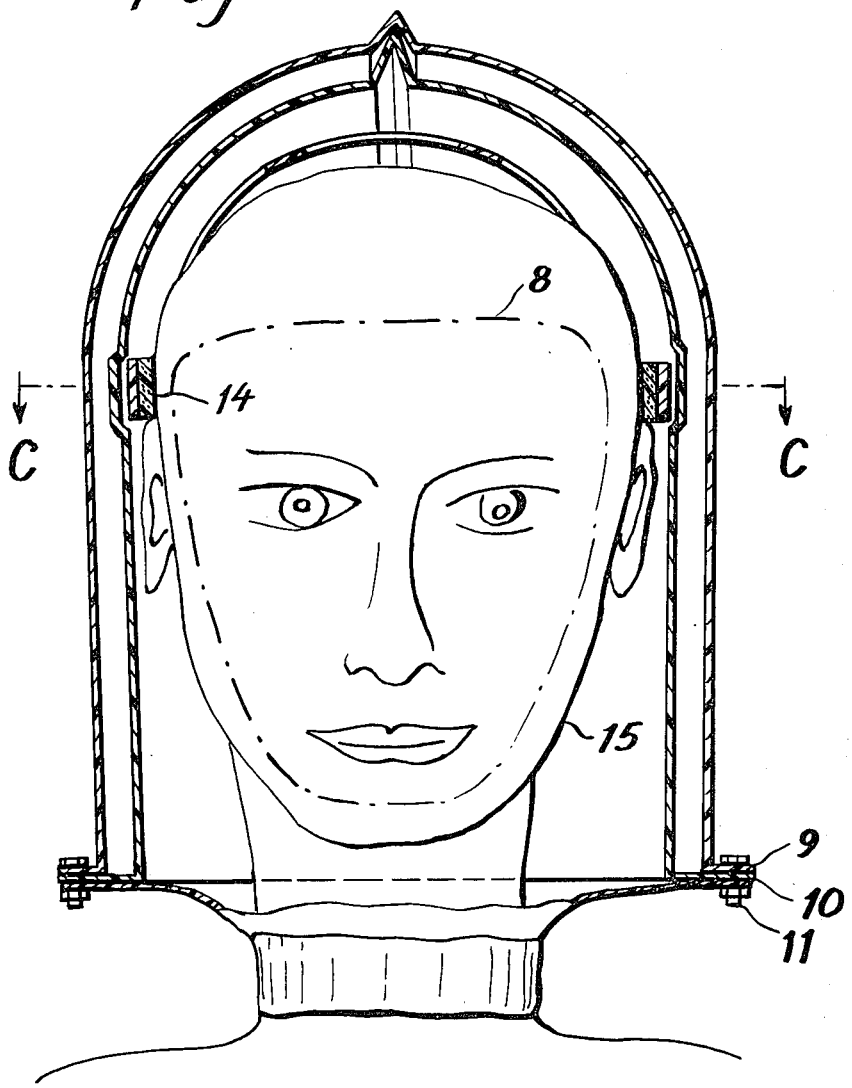
FIG. 1 shows a section of the protection-hood along the line A—A of FIG. 2.
Figure 2:
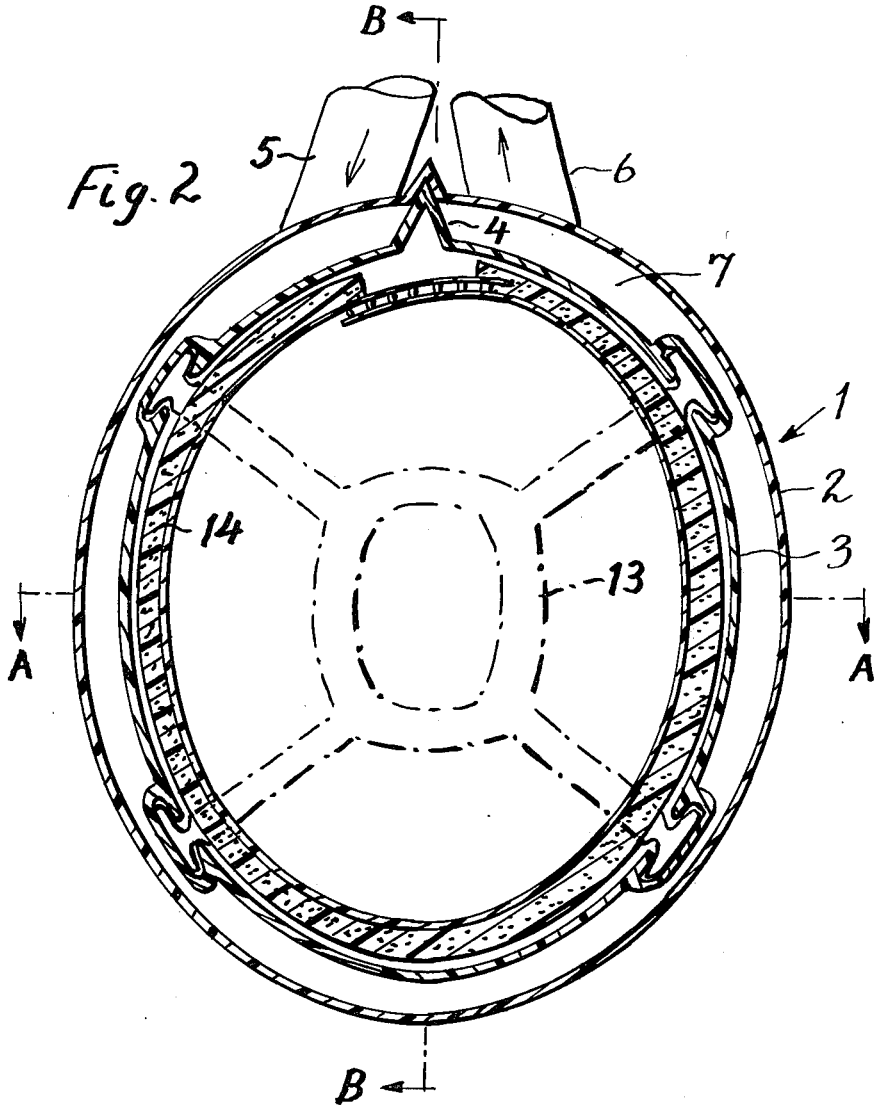
FIG. 2 shows a section of the hood along the line C—C of FIG. 1.
Figure 3:
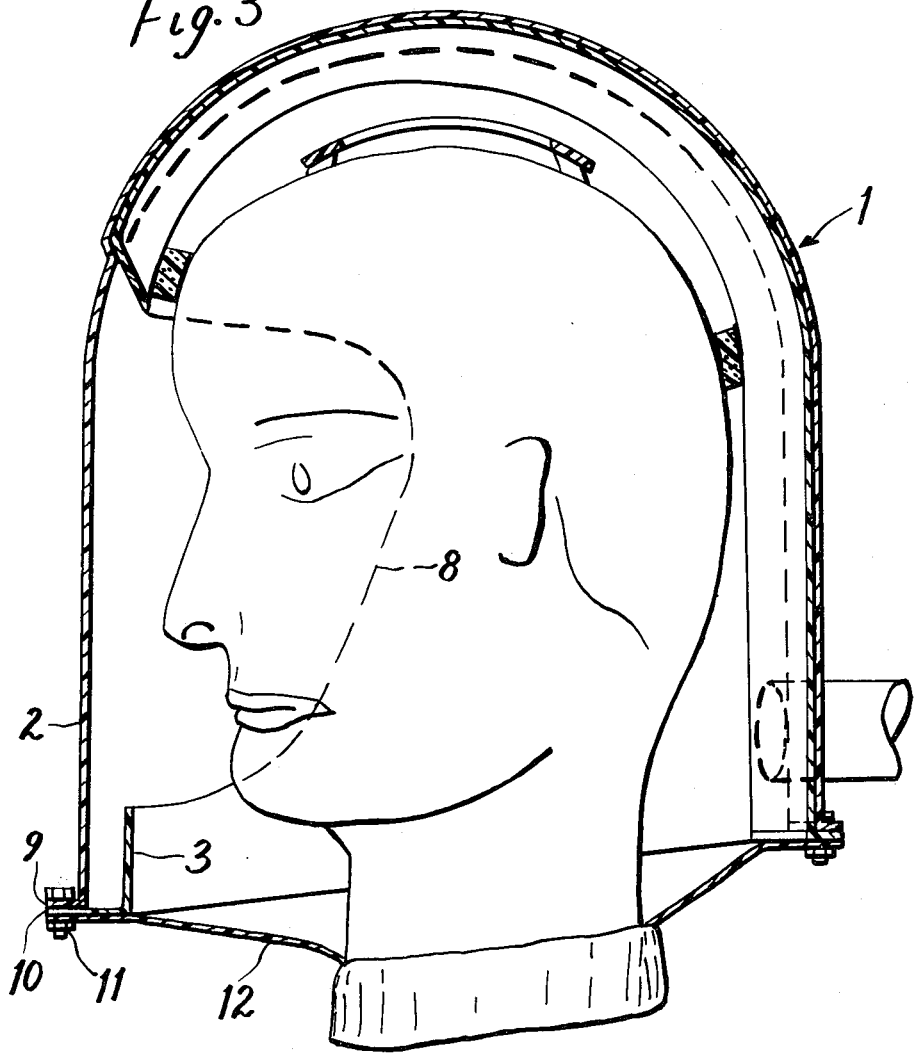
FIG. 3 shows a section along the line B-B of FIG. 2.

The protection-hood is in FIGS. 1 through 3 marked with the reference number 1 in general. It consists mainly of an outer wall 2, and inner wall 3 as well as a stiff partition wall 4, made in clear plastic, for example "LEXAN".

To the outer wall 2 on both sides of the partition wall 4 are secured two connectors for connecting of hoses 5 and 6 in such a way that air can be passed through one of the hoses into the space 7 between the walls 2 and 3 and thereafter out of the hood through the other hose. As driving force for the air can for example a fan (not shown) be used, either with the suction-side connected to one of the hoses 5 or 6 (for under pressure ventilation) or the pressure-side connected to one of the hoses 5 or 6 (for over-pressure ventilation).

To the hose through which the air flows into the hood, is connected a common filter (not shown) for absorbtion of dangerous and poisonous gases and aerosols. This hose can, in the case of under-pressure-ventilation, be omitted and the filter mounted directly upon the hood.

On the end of the inner wall 3, which is meant to stay in front of the mouth and the nose of the user, an opening 8 is provided, so the air, because of the partitioning wall 4 is fed past the opening so the user thereby may breathe freely without any resistance from any ventilators etc. The lower edges of the outer and inner walls 2 and 3, may be made with flanges 9 and 10, which may be fastened in an adequate way, as for example by nuts and screws 11. To the flange 10 on the inner wall 3 is fastened a collar of airtight material 12, which may be fastened with an elastic string around the users neck.

The protection-hood is kept in place by a harness 13 which is fastened to the inner wall 3 and may be of a similar type to that which is used in most protection helmets. To the harness is fastened a band 14 that may be regulated, made of foam-plastic or a similar material, so it, to a certain degree, may be fitted or regulated to size or headshape. There are also at proper places fastened straps 15 that may be fastened under the chin of the user.

When in use, unpolluted air is fed past the opening 8, without the user being subjected to any noticeable draught, at the same time as sufficient air is passed through the hood 1, so that used air and water vapor will be abducted.

An advantageous construction is to arrange for the partition wall 4 to run along the whole vertical length of the hood, and the hoses 5 and 6 are attached to the bottom of the back of the hood, and on either side of the partition wall 4, as the user then may work relatively freely.

It is obvious that changes may be made in the construction shown on the drawings. Among others, supporters that reach down to the shoulders of the user may be constructed. The shown connection of the inner and outer walls 2 and 3, as well as of the collar 12 may be effected by means of gluing, wleding etc., and the choice of material may depend on the use of the hood 1. It is also possible to construct the hood or the helmet-mask from some other material than clear plastic. Under working conditions where the plastic may be attacked by chemicals or other materials, it might be necessary to construct at least the viewing section of glass or a similar material, and the rest of the stiff part of the hood may be constructed of, for instance, aluminium. Even though the hood, according to the invention, is specially designed for protection against dust, gases, etc., it is obvious that it may also be used when diving in shallow waters. The advantage of the hood in such cases is that it is easy to breathe in, and draughts are avoided.

Having described my invention, I claim:

1. A helmet adapted completely to surround the head of the user and having means to seal the helmet to the user's body, the helmet being of double-walled construction comprising a pair of spaced inner and outer walls of stiff material, the inner wall having an opening in front and at least the outer wall being transparent at least where it overlies said opening, partition means extending between the inner and outer walls from the top of the opening of the inner wall rearwardly and downwardly to the bottom of the rear of the helmet, means to supply air to the space between said walls on one side of said partition means, and means to remove air from the space between said walls on the other side of said partition means whereby air passes from said supply means between said walls past said opening and again between said walls to said removing means.

2. A helmet as claimed in claim 1, said partition means being disposed in the vertical plane of symmetry of the helmet.

3. A helmet as claimed in claim 1, in which said walls are of clear plastic.

* * * * *